US008652276B2

(12) United States Patent
Nasserrafi et al.

(10) Patent No.: US 8,652,276 B2
(45) Date of Patent: Feb. 18, 2014

(54) SYSTEM AND METHOD FOR FORMING CONTOURED NEW AND NEAR-NET SHAPE TITANIUM PARTS

(75) Inventors: Rahbar Nasserrafi, Andover, KS (US); Darrell A. Wade, Wichita, KS (US); Thanh A. Le, Wichita, KS (US); Derek D. Donaldson, Mulvane, KS (US); Gary W. Sundquist, Newton, KS (US)

(73) Assignee: Sprint AeroSystems, Inc., Wichita, KS (US)

( * ) Notice: Subject to any disclaimer, the term of this patent is extended or adjusted under 35 U.S.C. 154(b) by 671 days.

(21) Appl. No.: 12/644,541

(22) Filed: Dec. 22, 2009

(65) Prior Publication Data

US 2011/0146854 A1 Jun. 23, 2011

(51) Int. Cl.

| | |
|---|---|
| ***C22F 1/18*** | (2006.01) |
| ***B21D 35/00*** | (2006.01) |
| ***B21D 37/16*** | (2006.01) |

(52) U.S. Cl.
USPC ..... 148/670; 72/342.1; 72/342.94; 72/342.96

(58) Field of Classification Search
USPC ..... 148/670, 669; 72/342.1, 342.94, 342.96
See application file for complete search history.

(56) References Cited

U.S. PATENT DOCUMENTS

| | | | | |
|---|---|---|---|---|
| 3,635,068 | A * | 1/1972 | Watmough et al. | 72/342.8 |
| 3,823,303 | A * | 7/1974 | Manchester et al. | 219/153 |
| 5,083,371 | A * | 1/1992 | Leibfried et al. | 29/889.72 |
| 6,616,775 | B2 * | 9/2003 | Hewitt | 134/38 |
| 2003/0217991 | A1 * | 11/2003 | Gomez | 219/50 |
| 2007/0231153 | A1 * | 10/2007 | Beckford et al. | 416/229 R |

OTHER PUBLICATIONS

Metals Handbook, "Forming of titanium and titanium alloys", Nov. 1993 (3rd printing), ASM International, 9th Edition, vol. 14, pp. 838-848.*

Wang et al. "Effect of temperature on vacuum hot bulge forming of BT20 titanium alloy cylindrical workpiece", 2007 (no month), Trans. Nonferrous Met. Soc. China, 17, pp. 957-962.*

* cited by examiner

*Primary Examiner* — Jessee Roe
(74) *Attorney, Agent, or Firm* — Hovey Williams LLP

(57) ABSTRACT

A system and method for shaping a net or near-net titanium part, the method comprising machining a piece of titanium into a titanium part having non-uniform thickness, heating the titanium part to a target temperature within a target temperature range between an auto-relief temperature of the titanium part and a minimum temperature required for super plastic forming of the titanium part, and lowering a die into the titanium part with sufficient force to shape the titanium part. The system for shaping the titanium part may comprise a multiple-axis machine, a die, electrical clamps, sensors, and a control system for adjusting heating temperatures based on information received from the sensors regarding the titanium part.

14 Claims, 4 Drawing Sheets

SYSTEM AND METHOD FOR FORMING CONTOURED NEW AND NEAR-NET SHAPE TITANIUM PARTS

BACKGROUND

1. FIELD

The present invention relates to titanium parts. More particularly, the invention relates to a system and method for making contoured net and near-net shape titanium parts for aircrafts and other applications.

2. RELATED ART

Titanium is frequently used for aircraft parts and other applications that are subjected to high stress and/or loads. Contoured titanium parts are commonly machined out of a large block of titanium, but this requires a large amount of material and complex machining equipment, such as a complex and expensive four or five-axis machine. Additionally, a block of titanium used to form the contoured part must be thick enough to allow machining the titanium part's contour. Much of the titanium block is machined away, resulting in a large percentage of wasted titanium.

Contoured titanium parts may also be formed by applying stress, pressure, or force to a sheet of titanium to curve or contour the titanium. However, this method is also problematic because titanium has a high yield strength, necessitating a large amount of force which produces residual stress in the titanium part. Additionally, the compressive strength of the die must be strong enough to cause the titanium to yield and to handle the force with which the die must be pressed into the titanium.

Another method of curving a sheet of titanium, called super plastic forming (SPF), involves heating the titanium to a temperature range which greatly reduces flow stresses of the titanium. However, SPF requires temperatures high enough to change the microstructure and resultant mechanical properties of the titanium. This change in microstructure properties are undesirable due to the affects it can have on the design and/or stress of the resulting titanium part.

SUMMARY

The present invention provides a system and method of manufacturing a contoured net or near-net shape titanium part of non-uniform thickness without using complex machinery and without damaging the mechanical properties of the titanium. The system may comprise a multi-axis machine, a die, electrical clamps, sensors, and a control system.

The multi-axis machine may be, for example, a three-axis machine for machining a piece of titanium into a into a net or near-net titanium part which is substantially flat and may have a profiled shape of non-uniform thickness. The die may be made of metal, ceramic, or a combination thereof. The titanium part may be heated by the die, Joule heating via the electrical clamps, external heaters, or a combination thereof.

To contour the titanium part by the force of portions of the die being forced together, the part may be heated to a target temperature within a target temperature range. The target temperature range may be between an auto-relief temperature and a minimum temperature required for super plastic forming of the titanium part. The target temperature and target temperature range for the titanium part may be determined based on any combination of the titanium part's shape, size, thickness, and thermal properties using finite element analysis.

The sensors and the control system may be used to adjust the heat of various portions of the titanium part so that an even amount of heat may be provided throughout the titanium part, regardless of the titanium part's thickness or thermal properties.

A method of manufacturing a contoured net or near-net titanium part may comprise machining a piece of titanium into a titanium part having non-uniform thickness. Then, the titanium part may be substantially uniformly heated to a target temperature within a target temperature range between an auto-relief temperature of the titanium part and a minimum temperature required for super plastic forming of the titanium part. Finally, a die may be lowered into the titanium part with sufficient force to shape the titanium part, resulting in a contoured net or near-net shape titanium part.

These and other important aspects of the present invention are described more fully in the detailed description below.

BRIEF DESCRIPTION OF THE DRAWINGS

Embodiments of the present invention are described in detail below with reference to the attached drawing figures, wherein.

Figure 1:
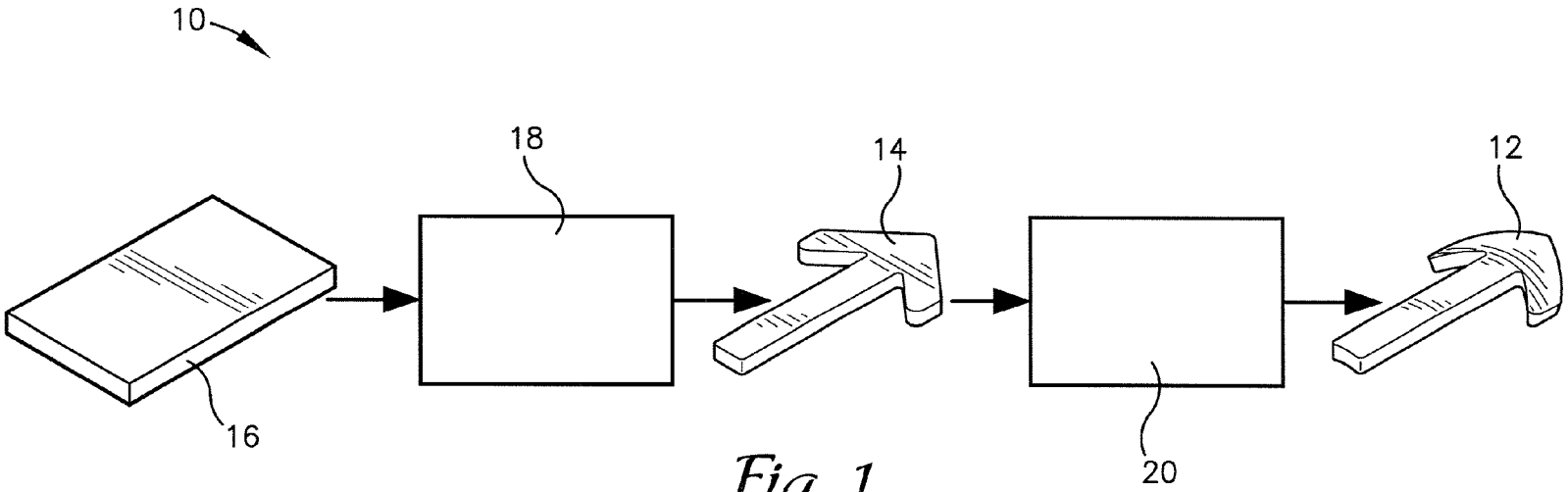
FIG. 1 is schematic flow diagram of a system, including a multi-axis machine and a thermal forming system, for forming a contoured net or near-net shape titanium part constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 3:
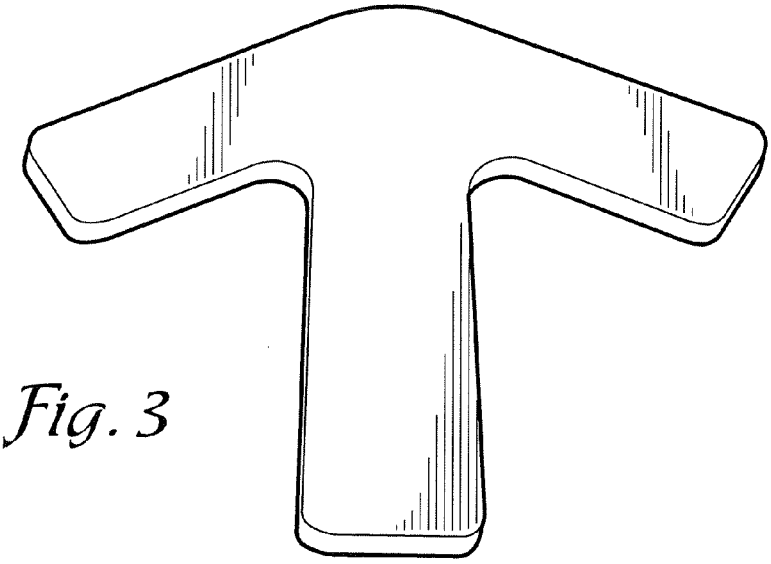
FIG. 3 is a perspective view of a net shape titanium part of FIG. 1.
Figure 4:
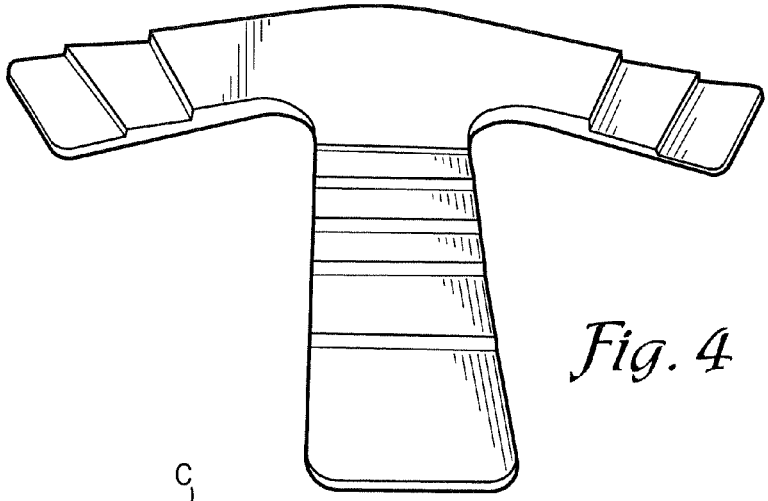
FIG. 4 is a perspective view of a near-net shape titanium part of FIG. 1.

FIG. 1 schematically illustrates a system 10 and process for making a contoured net or near-net shape titanium part 12 without the use of expensive machines and dies and without creating undesirable stresses or changes in the mechanical properties of the contoured titanium part 12. The contoured titanium part 12 may be formed out of a net shape or near-net shape titanium part 14, which may be a non-contoured titanium part that is substantially flat (net, as illustrated in FIG. 3) or substantially flat with a cut profile of varying or non-uniform thicknesses (near-net, as illustrated in FIG. 4). The titanium part 14 may be machined out of a blank or a piece of titanium 16, which may be made of Ti-6AL-4V or any other titanium alloy. The system 10 for forming the contoured net or near-net titanium part 12 may comprise a multi-axis machine 18 and a thermal forming system 20. The thermal forming system 20 may comprise a die 22, electrical clamps 24, thermometers and/or sensors 26, and a control system 28.

Figure 5:
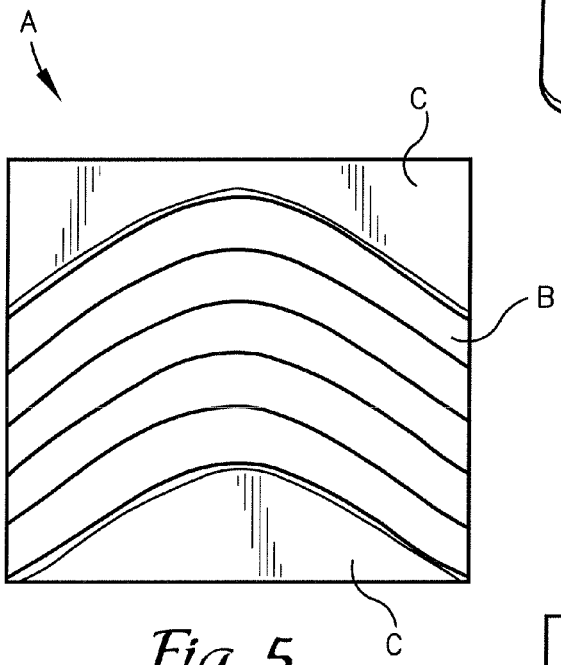
Fig. 5 (Prior Art)
FIG. 5 is a side view of a piece of titanium and a contoured titanium part to be cut therefrom according to a method of the prior art.
Figure 6:
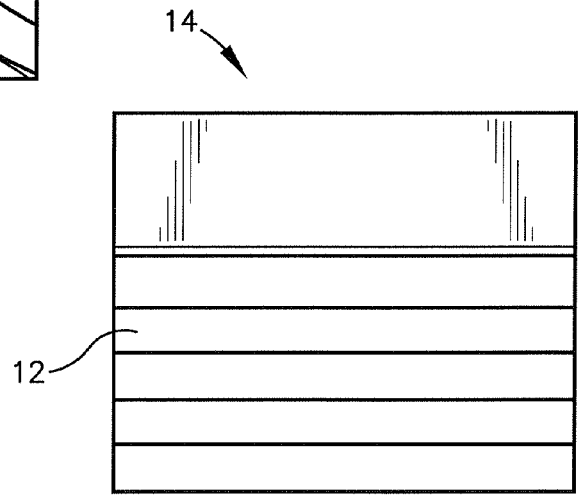
FIG. 6 is a side view of a piece of titanium and a substantially flat net shape titanium part to be cut therefrom in accordance with an embodiment of the present invention.

The multi-axis machine 18 may be a simple three-axis machine or any machine configured to form the net or near-net shape titanium part 14. However, a four or five-axis machine may also be used to manufacture the titanium part 14 without departing from the scope of the invention. As illustrated in FIG. 5, a prior art method of machining a piece of titanium (A) to form a contoured titanium part (B) required the piece (A) to be thick enough to allow machining of the part's contours, resulting in a large percentage of wasted titanium (C). Conversely, in various embodiments of the present invention, because the net and/or near-net shape titanium part 14 is flat or substantially flat, less material is required to machine this part, as illustrated in FIG. 6.

Figure 2:
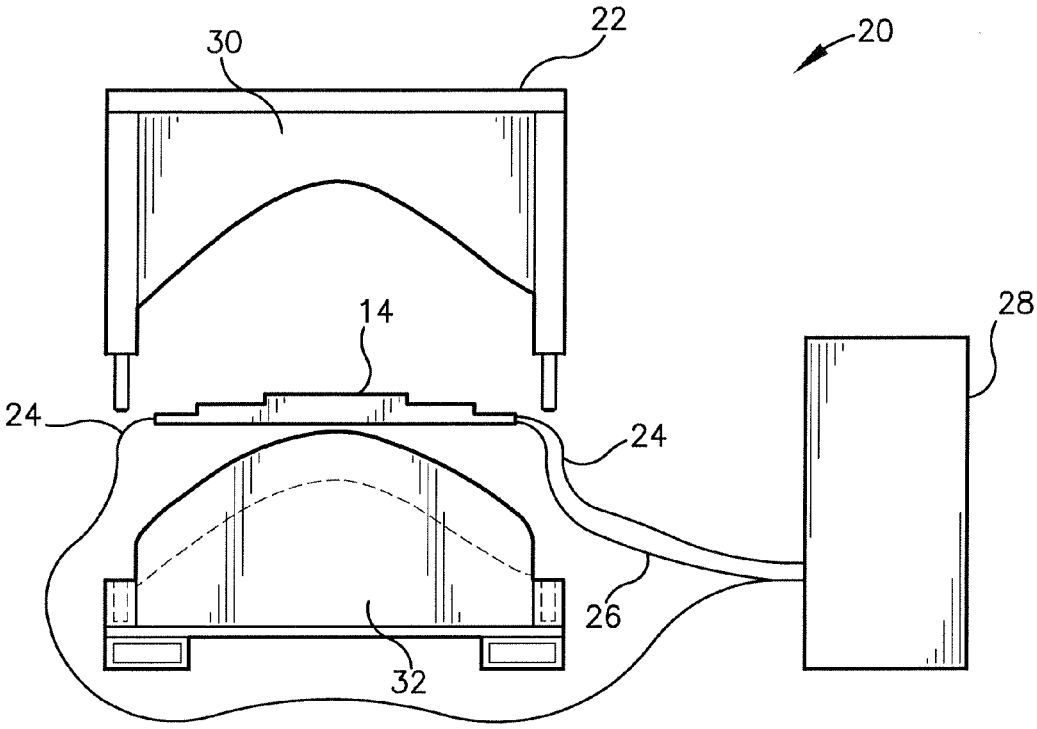
FIG. 2 is a schematic drawing of the thermal forming system of FIG. 1.

The die 22, illustrated in FIG. 2, may have an upper portion 30 and a lower portion 32, each shaped to mate with each other. The die 22 may be formed of ceramic, metal, or a combination of the two as a ceramic-metal hybrid die. For example, the upper portion of the die 22 and/or the lower portion of the die may be made of mild or low carbon steel, stainless steel, a nickel-based alloy, and/or ceramic. Furthermore, the upper portion 30 and lower portion 32 of the die 22 may be segmented dies or may each be machined as a single continuous piece.

Figure 7:
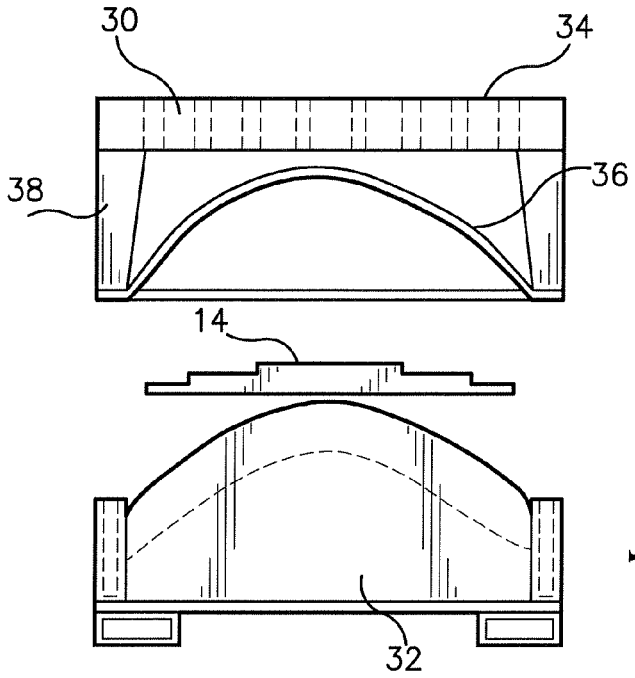
FIG. 7 is a cross-sectional view of a die of FIG. 2.

In one embodiment of the invention, illustrated in FIG. 7, the upper portion 30 of the die 22 may comprise a metal grate 34 separated a distance from a metal diaphragm 36 by a metal frame 38 connecting the grate 34 and the diaphragm 36. The metal diaphragm 36 may be configured to form to the shape of the lower portion 32. In this embodiment, the lower portion 32 may be a ceramic die.

The electrical clamps 24 may be any electrical conducting components or devices operable to apply an electric current to the titanium part for Joule heating the titanium part 14. Two or more clamps 24 may be used and may be attached to the titanium part 14 at a variety of locations. The amount and duration of electricity provided to the titanium part 14 may vary according to user inputs and/or control feedback loops based on monitored temperatures of the titanium part 14.

The thermometers and/or sensors 26 may be configured for monitoring temperatures and/or other characteristics of the titanium part 14. The thermometers and/or sensors 26 may be attached to the titanium part 14 and/or integral with either or both of the die 22 and the electrical clamps 24. The thermometers and/or sensors 26 may be connected in a feedback loop to the control system 28 which may determine how much current to provide to the clamps 24 and/or how much heat to provide to the die 22, for example. Wires, various circuitry, wireless transmitters and receivers, or any other devices for communicating real-time information about the titanium part 14 to the control system 28 may connect the thermometers and/or sensors 26 to the control system 28.

The control system 28 may be any system operable to actuate the upper and lower portions 30, 32 of the die 22 toward and away from each other, heat the die 22, heat the titanium part 14 via the electrical clamps 24, automatically adjust the amount of current or heat provided to the titanium part 14 in response to various data inputs, receive input from thermometers and/or sensors 26, users, databases, etc., record and store data related to the forming of the titanium part 14, and/or control the amount of time various heat sources may provide heat to the titanium part 14 and at what speed the resulting contoured titanium part 12 may be cooled. The control system 28 may be implemented in hardware, software, firmware, or any combination thereof.

The control system 28 may include any number of processors, controllers, integrated circuits, programmable logic devices, or other computing devices and resident or external memory for storing data and other information accessed and/or generated by sensors, thermometers, and/or actuators of the system 10. The control system is preferably coupled with the other components of the system 10 through wired or wireless connections to enable information to be exchanged between the various components.

The control system 28 may implement a computer program and/or code segments to perform the functions described herein. The computer program may comprise an ordered listing of executable instructions for implementing logical functions in the control system 28 such as some of the steps illustrated in FIG. 8 and described below. The computer program can be embodied in any computer-readable medium for use by or in connection with an instruction execution system, apparatus, or device, and execute the instructions. In the context of this application, a "computer-readable medium" can be any means that can contain, store, communicate, propagate, or transport the program for use by or in connection with the instruction execution system, apparatus, or device. The computer-readable medium can be, for example, but not limited to, an electronic, magnetic, optical, electromagnetic, infrared, or semi-conductor system, apparatus, device or propagation medium. More specific, although not inclusive, examples of the computer-readable medium would include the following: an electrical connection having one or more wires, a portable computer diskette, a random access memory (RAM), a read-only memory (ROM), an erasable, programmable, read only memory (EPROM or Flash memory), an optical fiber, and a portable compact disk read-only memory (CDROM).

Figure 8:
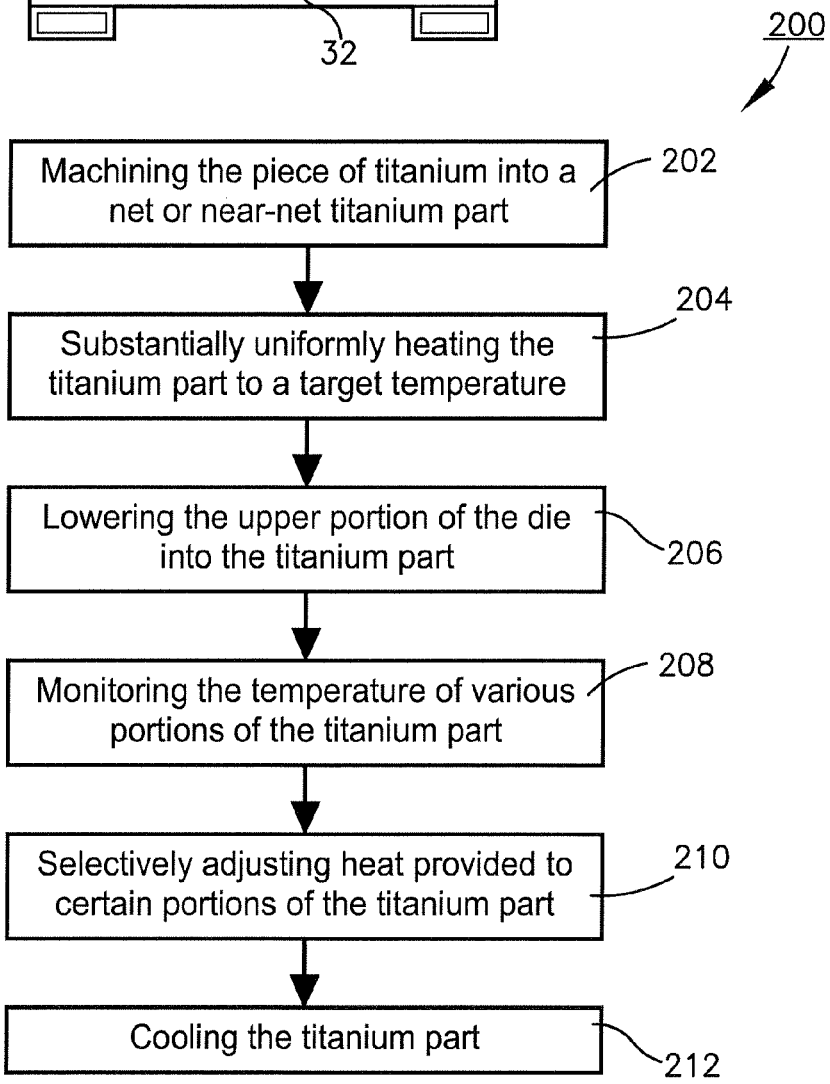
FIG. 8 is a flow chart illustrating a method of manufacturing a contoured net or near-net shape titanium part of FIG. 1.

A method 200 of forming the contoured net or near-net shape titanium part 12 is illustrated in FIG. 8. The first step 202 may comprise machining the piece of titanium 16 into a net or near-net titanium part 14. The titanium part 14 may be machined to any projected 2-dimensional shape having a plurality of angles, patterns, or designs. The titanium part 14 may also be machined to comprise a plurality of notches, steps, or other surface features machined into the part 14, causing the part 14 to be non-uniform in thickness.

Next, the method 200 may comprise substantially uniformly heating the titanium part 14 to a target temperature, as depicted in step 204. This may comprise placing the titanium part 14 in the die 22 and/or clamping the electrical clamps 24 to the part in a desired configuration. The titanium part 14 may be placed in the die 22 and may be heated via Joule heating using the electrical clamps 24 and/or may be heated by the die 22 itself. For example, the titanium part 14 may be heated by one or more of an oven, Joule heating, heated dies, hot forming, and creep forming. However, other heating methods may also be used without departing from the scope of the invention.

Particularly, the titanium part 14 may be substantially uniformly heated to the target temperature within a target range. The target range may be between an auto-relief temperature and a minimum temperature required for super plastic forming (SPF) of the titanium part 14. For example, the target temperature may be high enough to reduce the strength of the titanium part 14 sufficiently for flow stresses of the titanium part 14 to operate below a compressive strength of the die 22. Additionally, the target temperature may be below a temperature that changes a microstructure and resultant mechanical properties of the titanium part 14.

The target temperature and target range may be determined through testing or through finite element analysis (FEA). FEA may use any combination of a shape, size, thickness, and thermal properties of the titanium part 14 to determine the target range and/or the target temperature ideal for shaping the titanium part 14 without degrading its mechanical properties or creating undesirable stresses.

For example, for Ti-6AL-4V titanium parts, auto-relief may first occur at a temperature between approximately 1400 and 1425 degrees Fahrenheit. Auto-relief temperature is a temperature at which the titanium part 14 will automatically relieve all of its residual stresses. In this example, 100% stress relief under 3 minutes may occur at approximately 1425 degrees Fahrenheit, while 100% stress relief under 5 minutes may occur at approximately 1400 degrees Fahrenheit.

Additionally, for Ti-6AL-4V titanium parts, a minimum temperature required for SPF may be between approximately 1500 and 1550 degrees Fahrenheit. SPF temperatures are not desirable because SPF may change the mechanical properties and change the microstructure of the titanium part.

As depicted in step 206, the method 200 may also comprise lowering the upper portion 30 of the die 22 into the titanium part toward the lower portion 32 of the die 22 with sufficient force to shape or alter the shape of the part 14. As disclosed above, the control system 28 may actuate either or both of the upper and lower portions 30, 32 toward each other. Alternatively, a manual actuator (not shown), such as a lever, may be used to urge at least one of the upper and lower portions 30, 32 toward each other with a desired amount of force.

In step 208, the temperature of various portions of the titanium part 14 are monitored. For example, if the titanium part 14 does have varying thicknesses, thinner portions of the titanium part 14 may heat faster than thicker portions of the titanium part 14. In response to information received by the thermometers and/or sensors 26 monitoring the temperature of the various portions of the titanium part 14, heat provided to at least one of the portions of the titanium part 14 may be adjusted independently of the heat provided to at least one other of the portions of the titanium part 14, as depicted in step 210. In this way, the heat provided to certain portions of the titanium part 14 may be selectively adjusted. The amount of adjustment, the portion to be adjusted, and the duration of the adjustment may be based on the monitored temperatures and the target temperature or target temperature range for the titanium part 14, as well as any other data stored in the control system 28. Adjusting the heat may comprise adjusting a current path, adjusting current input, switching power entry locations, and/or regulating power levels with Joule heating. These adjustments may be made with or without the use of heated dies or external heaters.

Once the titanium part 14 is heated for a desired amount of time at a desired target temperature, the resulting contoured titanium part 12 may be cooled, as depicted in step 212. The contoured titanium part 12 may be cooled at room temperature or may be cooled at a rate controlled by the control system 28. The contoured titanium part 12 may also undergo a simple chemical milling process to remove thermally-induced alpha case from the contoured titanium part 12.

In some embodiments of the invention, the titanium part 14 is independently heated by Joule heating while the upper and lower portions 30, 32 of the die 22 are not independently heated. However in other embodiments of the invention, the upper and lower portions 30, 32 of the die 22 may be independently heated and the titanium part 14 may also be independently and simultaneously heated by Joule heating.

Although the invention has been described with reference to the embodiments illustrated in the attached drawings, it is noted that equivalents may be employed and substitutions made herein without departing from the scope of the invention as recited in the claims.

Having thus described an embodiment of the invention, what is claimed as new and desired to be protected by Letters Patent includes the following:

1. A method of making a contoured net or near-net shape titanium part, the method comprising:

machining a piece of titanium into a titanium part having non-uniform thickness;

substantially uniformly heating the titanium part to a target temperature within a target temperature range above an auto-relief temperature of the titanium part and below a minimum temperature required for super plastic forming temperature of the titanium part; and lowering a first die into the titanium part, pressing the titanium part into a second die, thereby shaping the titanium part, further comprising determining at least one of a target temperature and a target temperature range for the titanium part based on any combination of the titanium part's shape, size, thickness, and thermal properties using finite element analysis.

2. The method of claim 1, wherein the onset of the auto-relief temperature is a temperature between approximately 1400 and 1425 degrees Fahrenheit and the onset of the super plastic forming temperature is a temperature between approximately 1500 and 1550 degrees Fahrenheit.

3. The method of claim 1, further comprising:

monitoring temperatures of a plurality of portions of the titanium part; and adjusting heat provided to at least one of the plurality of portions of the titanium part based on the monitored temperature of the portions and the target temperature or target temperature range for the titanium part.

4. The method of claim 1, wherein the titanium part is heated by one or more of an oven, Joule heating, heated dies, hot forming, and creep forming.

5. The method of claim 1, wherein the die is made of at least one of mild or low carbon steel, stainless steel, a nickel-based alloy, and ceramic.

6. The method of claim 1, wherein machining the piece of titanium comprises machining the piece of titanium into a substantially flat net or near-net shape titanium part.

7. The method of claim 1, wherein the titanium part is heated by one or more of an oven, Joule heating, heated dies, hot forming, and creep forming, wherein at least one of the upper die and the lower die is made of at least one of mild or low carbon steel, stainless steel, a nickel-based alloy, and ceramic.

8. A method of making a contoured net or near-net shape titanium part, the method comprising:

machining a piece of titanium into a into a substantially flat net or near-net shape titanium part having a profiled shape of non-uniform thickness;

substantially uniformly heating the titanium part to a target temperature within a target temperature range above an auto-relief temperature and below a minimum temperature required for super plastic forming of the titanium part;

lowering an upper die into the titanium part toward a lower die with sufficient force to contour the titanium part;

monitoring temperatures of a plurality of portions of the titanium part;

adjusting heat provided to at least one of the plurality of portions of the titanium part based on the monitored temperature of the portions and the target temperature or target temperature range for the titanium part; and cooling the contoured titanium part.

9. The method of claim 8, wherein the upper and lower dies are not heated and the titanium part is independently heated by Joule heating.

10. The method of claim 8, wherein the upper and lower dies are independently heated and the titanium part is independently heated by Joule heating.

11. The method of claim 8, wherein the onset of the auto-relief temperature is a temperature between approximately 1400 and 1425 degrees Fahrenheit and the minimum temperature required for super plastic forming is a temperature between approximately 1500 and 1550 degrees Fahrenheit.

12. The method of claim 8, wherein adjusting the heat comprises at least one of adjusting a current path, adjusting current input, switching power entry, and regulating power levels with Joule heating.

13. The method of claim 8, further comprising determining at least one of a target temperature and a target temperature range for the titanium part based on any combination of the titanium part's shape, size, thickness, and thermal properties using finite element analysis.

14. A method of making a contoured net or near-net shape titanium part, the method comprising:

machining a piece of titanium into a substantially flat net or near-net shape titanium part having a profiled or non-uniform thickness;

placing the titanium part between an upper portion and a lower portion of a ceramic or ceramic-metal hybrid die;

substantially uniformly heating the titanium part to a target temperature, wherein the target temperature is high enough to reduce the strength of the titanium part sufficiently for flow stresses of the titanium part to operate below a compressive strength of the ceramic or ceramic-metal hybrid die, and wherein the target temperature is below a temperature that changes a microstructure and resultant mechanical properties of the titanium part; and lowering the upper portion of the die into the titanium part with sufficient force to alter the shape of the titanium part.

* * * * *

UNITED STATES PATENT AND TRADEMARK OFFICE

CERTIFICATE OF CORRECTION

PATENT NO. : 8,652,276 B2
APPLICATION NO. : 12/644541
DATED : February 18, 2014
INVENTOR(S) : Nasserrafi et al.

It is certified that error appears in the above-identified patent and that said Letters Patent is hereby corrected as shown below:

On the title page, item (73) Assignee, should read as follows:

(73) Assignee: Spirit AeroSystems, Inc.

Signed and Sealed this
Twenty-ninth Day of September, 2015

Michelle K. Lee

Michelle K. Lee
*Director of the United States Patent and Trademark Office*